US009630334B2

(12) United States Patent
Garcia

(10) Patent No.: US 9,630,334 B2
(45) Date of Patent: Apr. 25, 2017

(54) FOOD CUTTING ASSEMBLY

(71) Applicant: Lucio Garcia, Krum, TX (US)

(72) Inventor: Lucio Garcia, Krum, TX (US)

( * ) Notice: Subject to any disclaimer, the term of this patent is extended or adjusted under 35 U.S.C. 154(b) by 6 days.

(21) Appl. No.: 14/750,560

(22) Filed: Jun. 25, 2015

(65) Prior Publication Data

US 2016/0375599 A1 Dec. 29, 2016

(51) Int. Cl.
*B26D 3/24* (2006.01)
*B26D 3/26* (2006.01)

(52) U.S. Cl.
CPC ..... *B26D 3/245* (2013.01); *B26D 3/26* (2013.01)

(58) Field of Classification Search
CPC ..... B26D 3/245; B26D 3/26
USPC ..... 30/114, 316, 115, 301–305
See application file for complete search history.

(56) References Cited

U.S. PATENT DOCUMENTS 198,219 A * 12/1877 Schell., Jr. ..... A21C 11/106 30/301
1,364,863 A * 1/1921 Buchtel ..... B26B 3/04 30/303
1,581,310 A * 4/1926 Fetschan ..... B26D 3/24 30/114
1,853,140 A * 4/1932 Morrison ..... B26D 3/185 30/303
2,502,157 A * 3/1950 Klejna ..... B26D 3/185 30/303
3,132,423 A * 5/1964 De Lano ..... B26D 3/24 30/114
4,572,444 A * 2/1986 Shadduck ..... B26D 3/26 241/168
D304,403 S 11/1989 Wolff
5,388,489 A 2/1995 Dayley
D501,371 S * 2/2005 Lo ..... D7/673
7,266,894 B1 * 9/2007 Hinckley ..... B26D 1/0006 30/302
7,975,396 B2 7/2011 Mastroianni
8,046,921 B2 * 11/2011 Mastroianni ..... A47J 25/00 30/113.2
D658,950 S 5/2012 Plank et al.
D716,109 S * 10/2014 De Luca ..... D7/672
2007/0148301 A1 6/2007 Finkowski et al.
(Continued)

FOREIGN PATENT DOCUMENTS

FR 2 979 213 * 3/2013

OTHER PUBLICATIONS

English translation of FR 2 979 213, Mar. 2013.*

*Primary Examiner* — Hwei C Payer

(57) ABSTRACT

A food cutting assembly includes an outer ring has a circular shape. The outer ring has an inner surface, an outer surface and a bottom edge comprising a blade. A pair of handles is attached to the outer surface. A plurality of cutting members is attached to and extending between the outer ring and an inner ring such that the inner ring is coaxial with the outer ring. Each of the cutting members has a lower edge comprising a blade. The lower edges of the cutting members and the bottom edge are co-planar. An intermediate ring has a first edge and a second edge positioned opposite of each other wherein the second edge is directed downwardly and comprises a blade. The intermediate ring is removably attached to the cutting members such that the second edge is co-planar with the lower edges.

8 Claims, 4 Drawing Sheets

(56) References Cited

U.S. PATENT DOCUMENTS

| | | | | |
|---|---|---|---|---|
| 2009/0205514 | A1* | 8/2009 | Cheng | A47J 25/00 99/565 |
| 2012/0060373 | A1 | 3/2012 | Spreen | |
| 2012/0207899 | A1 | 8/2012 | Serebryany et al. | |

* cited by examiner

FOOD CUTTING ASSEMBLY

BACKGROUND OF THE DISCLOSURE

Field of the Disclosure

The disclosure relates to food cutting devices and more particularly pertains to a new food cutting device for dividing food into a plurality of sections.

SUMMARY OF THE DISCLOSURE

An embodiment of the disclosure meets the needs presented above by generally comprising an outer ring has a circular shape. The outer ring has an inner surface, an outer surface and a bottom edge comprising a blade. A pair of handles is attached to the outer surface and are positioned opposite of each other. A plurality of cutting members is attached to and extending between the outer ring and an inner ring such that the inner ring is coaxial with the outer ring. Each of the cutting members has a lower edge comprising a blade. The lower edges of the cutting members and the bottom edge is co-planar. An intermediate ring has a larger diameter than the inner ring and a smaller diameter than the outer ring. The intermediate ring has a first edge and a second edge positioned opposite of each other wherein the second edge is directed downwardly and comprises a blade. The intermediate ring is removably attached to the cutting members such that the second edge is co-planar with the lower edges.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
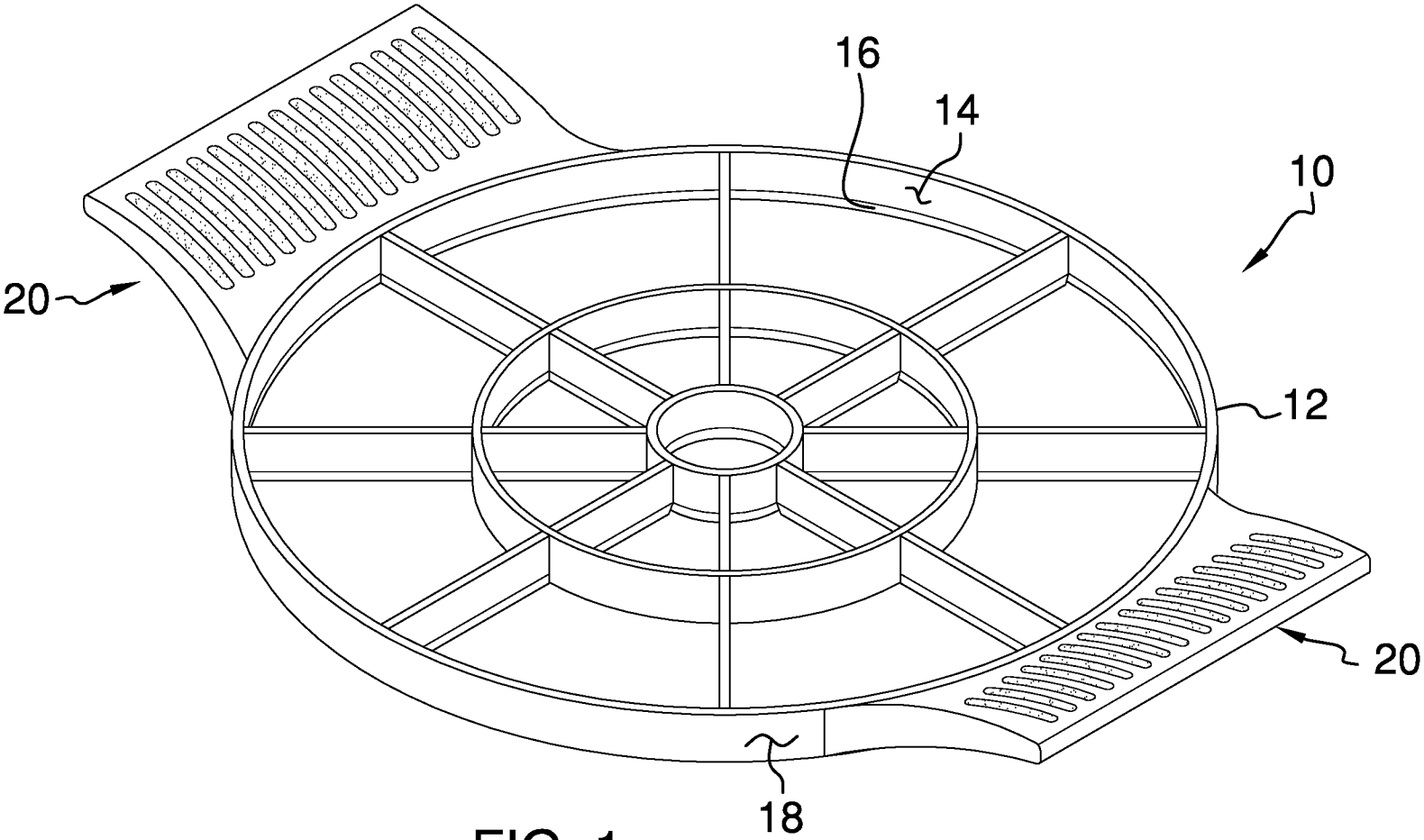
FIG. 1 is a top perspective view of a food cutting assembly according to an embodiment of the disclosure.
Figure 2:
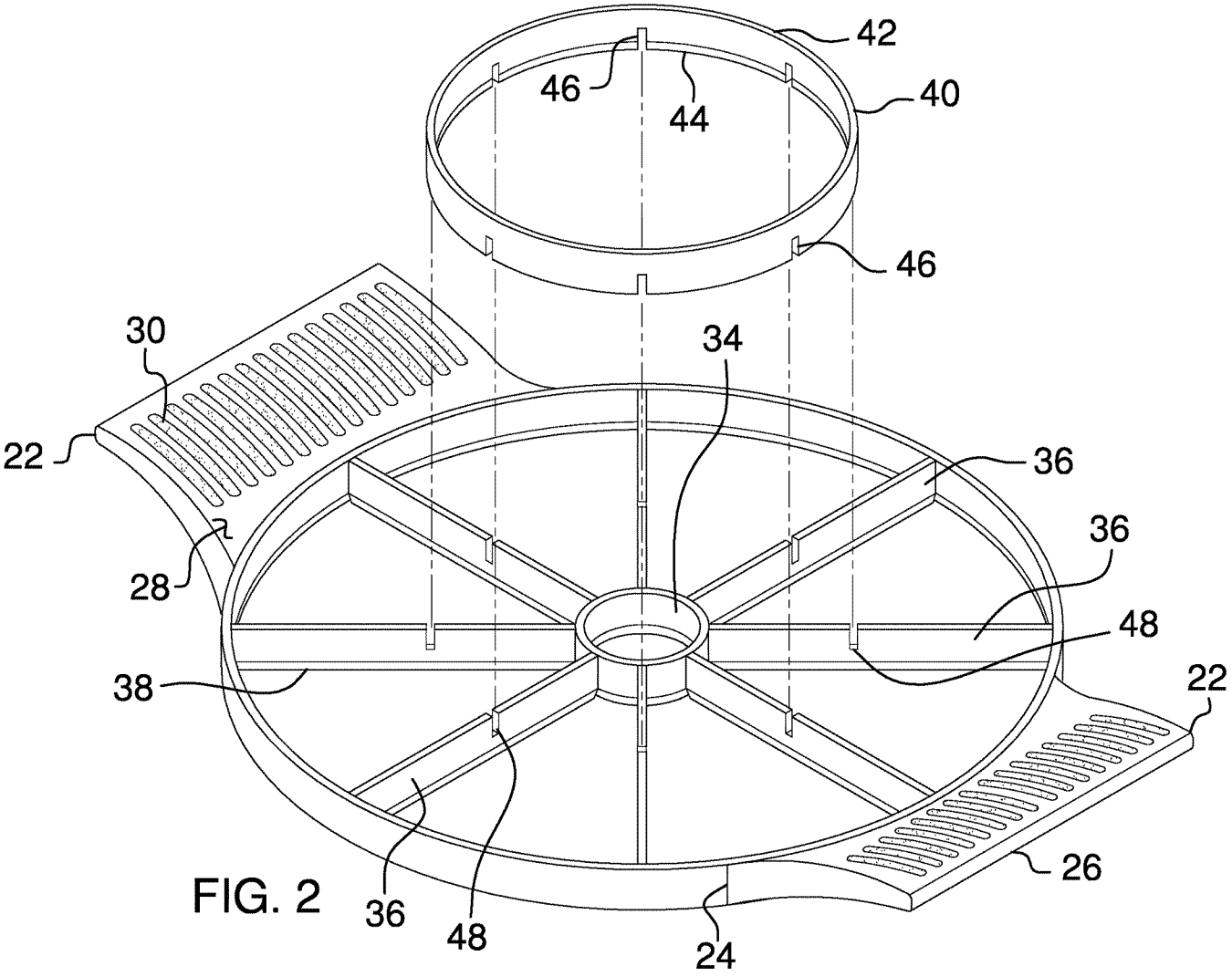
FIG. 2 is a top perspective view of an embodiment of the disclosure.
Figure 3:
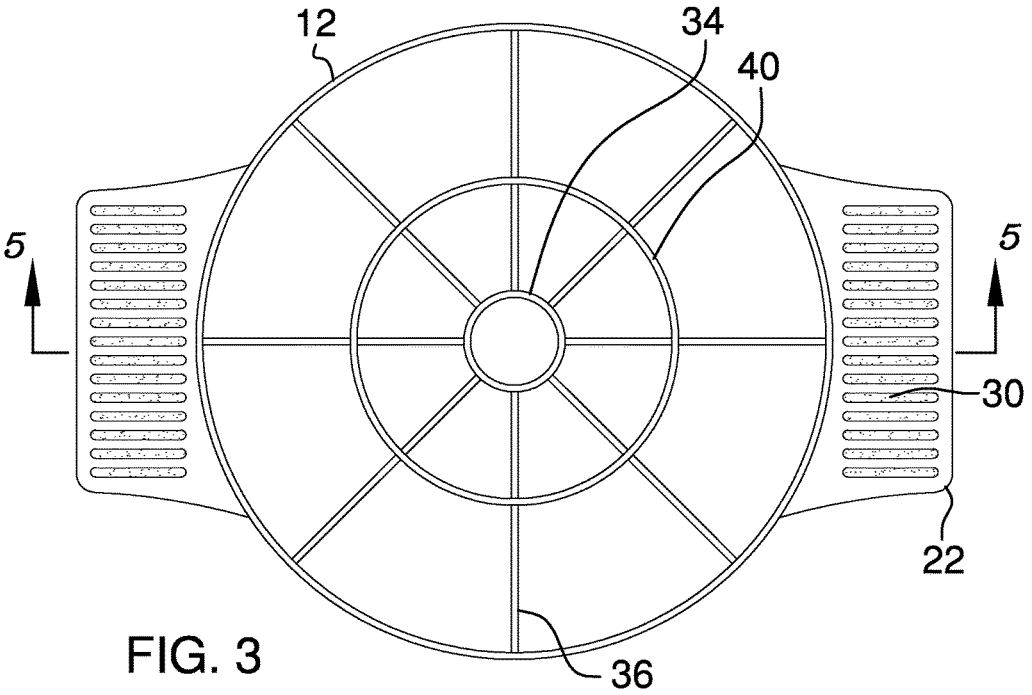
FIG. 3 is a top view of an embodiment of the disclosure.
Figure 4:
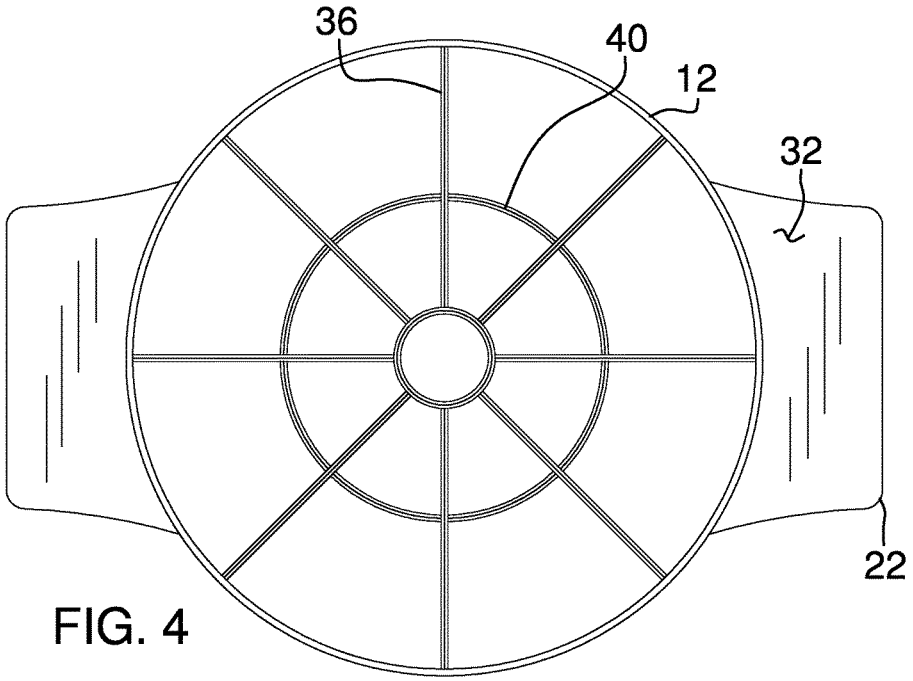
FIG. 4 is a bottom view of an embodiment of the disclosure.
Figure 5:
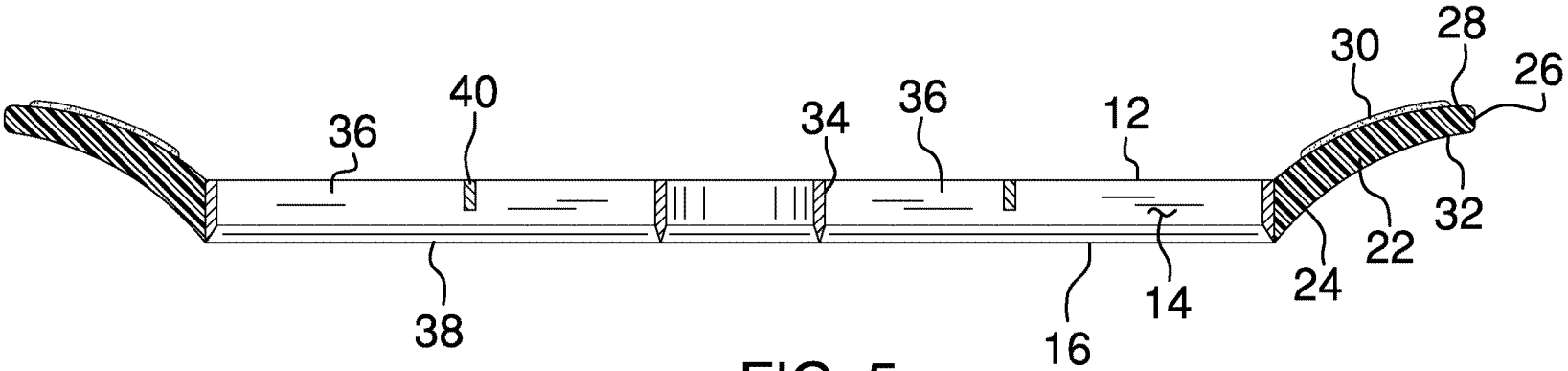
FIG. 5 is a cross-sectional view of an embodiment of the disclosure taken along line 5-5 of FIG. 3.

With reference now to the drawings, and in particular to FIGS. 1 through 5 thereof, a new food cutting device embodying the principles and concepts of an embodiment of the disclosure and generally designated by the reference numeral 10 will be described.

As best illustrated in FIGS. 1 through 5, the food cutting assembly 10 generally comprises an outer ring 12 having a circular shape. The outer ring 12 has an inner surface 14, an outer surface 18 and a bottom edge 16. The bottom edge 16 comprises a blade which is coextensive with the bottom edge 16. The outer ring 12 has a diameter between 7.0 inches and 11.0 inches.

A pair of handles 20 is provided and each of the handles 20 is attached to the outer surface 18. The handles 20 are positioned opposite of each other. The handles 20 each comprise a panel 22 that has an attached edge 24 and a distal edge 26 with respect to the outer ring 12. Each of the panels 22 extends outwardly and upwardly from the outer ring 12 from the attached edges 24 to an associated one of the distal edges 26. The panels 22 each has an upper surface 28 having a grip enhancing material 30 positioned thereon. The grip enhancing material 30 may comprise a plurality of elongated elastomeric strips. The upper surface 28 may be convexly arcuate and the panels 22 may have a lower surface 32 that is concavely arcuate.

An inner ring 34 is provided that may have a diameter is less than 2.0 inches. A plurality of cutting members 36 is attached to and extends between the outer ring 12 and the inner ring 34 such that the inner ring 34 is coaxial with the outer ring 12. The cutting members 36 are straight and each of the cutting members 36 has a lower edge 38 comprising a blade. The lower edges 38 of the cutting members 36 and the bottom edge 16 are co-planar with respect to each other.

An intermediate ring 40 has a diameter larger than the inner ring 34 and smaller than the outer ring 12. The intermediate ring 40 has a first edge 42 and a second edge 44 positioned opposite of each other wherein the second edge 44 is directed downwardly and comprises a blade. The intermediate ring 40 is removably attached to the cutting members 36 such that the second edge 44 is co-planar with the lower edges 38. The intermediate ring 40 includes a plurality of notches 46 that are releasably engageable with slots 48 in the cutting members 36 to frictionally couple the intermediate ring 40 to the cutting members 36. The intermediate ring 40 may have, for instance, a diameter is between 3.0 inches and 6.0 inches.

In use, the assembly 10 is typically used to cut baked goods or other foods having similar characteristics. More particularly, the outer ring 12 is extended around food such as cake, pancakes, or the like, and pressed down so that the cutting members 36 and inner ring 34 cut the food into discrete sections. The intermediate ring 40 may be used to further divide the food which may be useful for cutting particular foods into sizes for eating such as cutting pancakes.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A food cutting tool comprising:

an outer ring having a circular shape, said outer ring having an inner surface, an outer surface and a bottom edge, said bottom edge comprising a blade;

a pair of handles, each of said handles being attached to said outer surface, said handles being positioned opposite of each other;

an inner ring;

a plurality of cutting members being attached to and extending between said outer ring and said inner ring such that said inner ring is coaxial with said outer ring, each of said cutting members having a lower edge comprising a blade, said lower edges of said cutting members and said bottom edge being co-planar; and an intermediate ring having a diameter larger than that of said inner ring and smaller than that of said outer ring, said intermediate ring having a first edge and a second edge positioned opposite of each other wherein said second edge is directed downwardly and comprises a blade, said intermediate ring being removably attached to said cutting members such that said second edge is co-planar with said lower edges.

2. The food cutting tool according to claim 1, wherein said outer ring has a diameter between 7.0 inches and 11.0 inches.

3. The food cutting tool according to claim 1, wherein said handles each comprising a panel having an attached edge and a distal edge with respect to said outer ring, each of said panels extending outwardly and upwardly from said outer ring from said attached edges to an associated one of said distal edges.

4. The food cutting tool according to claim 3, wherein said panels each have an upper surface having a grip enhancing material positioned thereon.

5. The food cutting tool according to claim 2, wherein said inner ring has a diameter being less than 2.0 inches.

6. The food cutting tool according to claim 1, wherein said intermediate ring includes a plurality of notches being releasably engageable with slots in said cutting members to frictionally couple said intermediate ring to said cutting members.

7. The food cutting tool according to claim 5, wherein said intermediate ring has a diameter being between 3.0 inches and 6.0 inches.

8. A food cutting tool comprising:

an outer ring having a circular shape, said outer ring having an inner surface, an outer surface and a bottom edge, said bottom edge comprising a blade, said outer ring having a diameter between 7.0 inches and 11.0 inches;

a pair of handles, each of said handles being attached to said outer surface, said handles being positioned opposite of each other, said handles each comprising a panel having an attached edge and a distal edge with respect to said outer ring, each of said panels extending outwardly and upwardly from said outer ring from said attached edges to an associated one of said distal edges, said panels each having an upper surface having a grip enhancing material positioned thereon;

an inner ring, said inner ring having a diameter being less than 2.0 inches;

a plurality of cutting members being attached to and extending between said outer ring and said inner ring such that said inner ring is coaxial with said outer ring, each of said cutting members having a lower edge comprising a blade, said lower edges of said cutting members and said bottom edge being co-planar; and an intermediate ring having a diameter larger than that of said inner ring and smaller than that of said outer ring, said intermediate ring having a first edge and a second edge positioned opposite of each other wherein said second edge is directed downwardly and comprises a blade, said intermediate ring being removably attached to said cutting members such that said second edge is co-planar with said lower edges, said intermediate ring including a plurality of notches being releasably engageable with slots in said cutting members to frictionally couple said intermediate ring to said cutting members, said intermediate ring having a diameter being between 3.0 inches and 6.0 inches.

* * * * *